US005659925A

United States Patent [19]

Patterson

[11] Patent Number: 5,659,925

[45] Date of Patent: Aug. 26, 1997

[54] DOOR CLOSER HOLDING MECHANISM

[76] Inventor: E. Ennalls Patterson, 2007 Ryan's Run, Lansdale, Pa. 19446

[21] Appl. No.: 617,523

[22] Filed: Feb. 21, 1996

[51] Int. Cl.[6] ..... E05F 5/02

[52] U.S. Cl. ..... 16/82; 16/49; 16/84

[58] Field of Search ..... 16/82, 84, 85, 16/71, 72, 49, 66, DIG. 10; 292/DIG. 12, DIG. 19, DIG. 15, 341.15, 262, 267, 278

[56] References Cited

U.S. PATENT DOCUMENTS

| | | | |
|---|---|---|---|
| 3,105,264 | 10/1963 | Truhon | 16/66 |
| 3,708,825 | 1/1973 | Wood | 16/49 |
| 4,194,264 | 3/1980 | Stoffregen | 16/52 |
| 4,639,969 | 2/1987 | Obenshain | 16/70 |
| 4,813,100 | 3/1989 | King | 16/82 |
| 4,815,163 | 3/1989 | Simmons | 16/82 |

*Primary Examiner*—Chuck Y. Mah

[57] ABSTRACT

A holding mechanism attached to a generic door closing cylinder that allows a person to pass through a doorway unimpeded while having both hands occupied, or while manipulating a baby stroller through a doorway, then closing said door without the use of the hands.

1 Claim, 1 Drawing Sheet

DOOR CLOSER HOLDING MECHANISM

BACKGROUND OF THE INVENTION

The invention relates in general to the difficulty of manipulating a self closing screen/storm door under certain conditions.

It is generally agreed upon that in order to enter a house that has a cylinder type closing device, one must put all packages down, open the door, slide the small, bent metal catch to a position that will then hold the door open. Packages can then be picked up and brought into the house. After putting said packages in a convenient place, one must return and slide the catch back to its original position before the door can be closed. Much the same occurs when transporting a baby stroller through the doorway. In the meantime, forces of nature in the form of cold winds or flies have easy access to the interior of the home.

SUMMARY OF THE INVENTION

A newly designed device that attaches directly to a generic closing cylinder that allows the person entering the house to secure the door in place simply by opening said door to its full capacity. After entering, even with hands full or both hands directing a baby stroller, one can dose the door with the touch of a toe against a releasing means.

BRIEF DESCRIPTION OF THE INVENTION

FIG. 1 is a plan view of the invention connected to the standard bracket that attaches most closing devices of the cylinder type to the door jamb. The standard connecting pin is removed and replaced with a right-angle bar having a reduced size tip that fits into the swivel hole in the bracket. The body of the invention lies on top of the cylinder. FIG. 1 shows the cylinder in a closed position.

DESCRIPTION OF THE PREFERRED EMBODIMENTS

Figure 1:
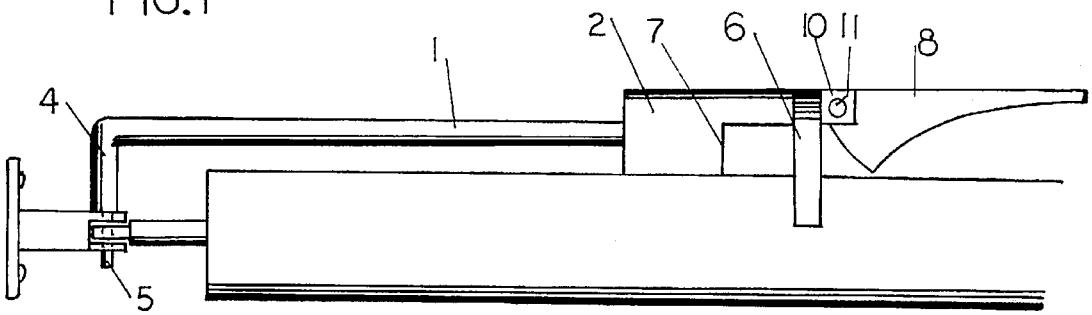
Figure 2:
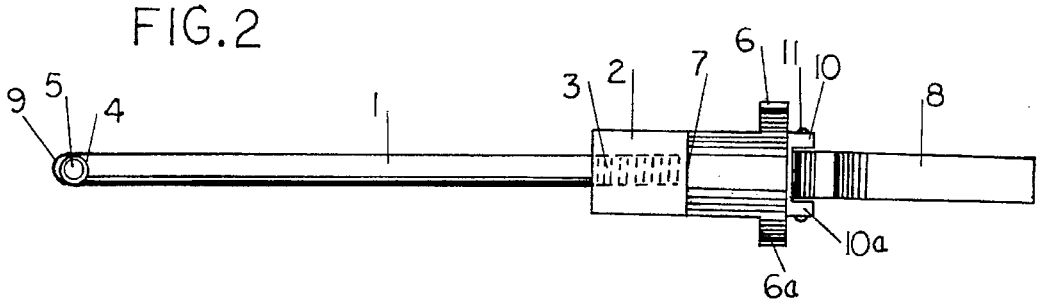
FIG. 2 is a plan view of FIG. 1 but shown from the under side.
Figure 4:
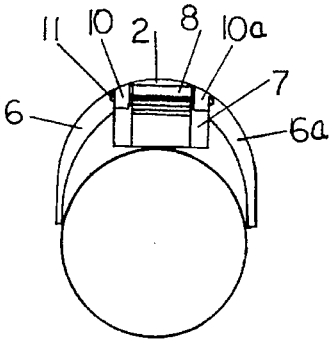
FIG. 4 is an isometric view of the device riding the top of the cylinder and showing the stabilizing legs on either side of the cylinder.
Figure 5:
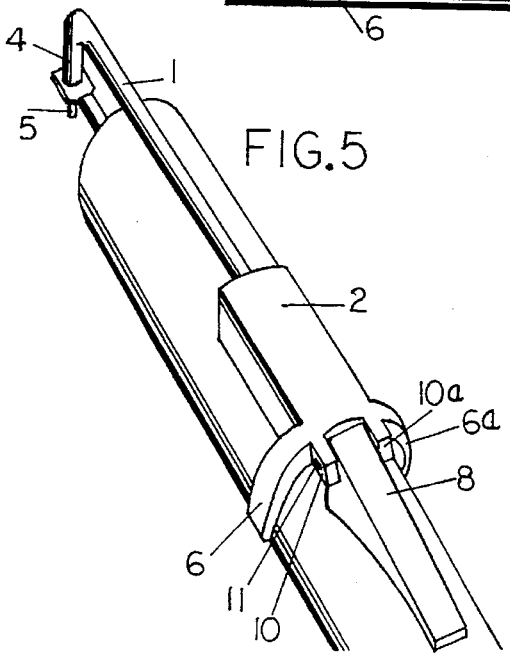
FIG. 5 is a plan view of the device from the end with the legs astride the cylinder.

Referring to the drawings and in particular to FIG. 1, a steel rod 1 is attached by threading into a durable plastic block 2. See FIG. 2, threaded section 3. The right-angle section 4 formed from the steel rod 1 has a reduced size tip 5 that fits into the hole of a standard swivel bracket when the standard connecting pin is removed. When the door is closed and the cylinder is retracted, block 2 rides in a parallel path atop the cylinder. Legs 6 and 6*a* extend below the top of the cylinder in a straddling mode that maintains alignment. See FIG. 4.

Figure 3:
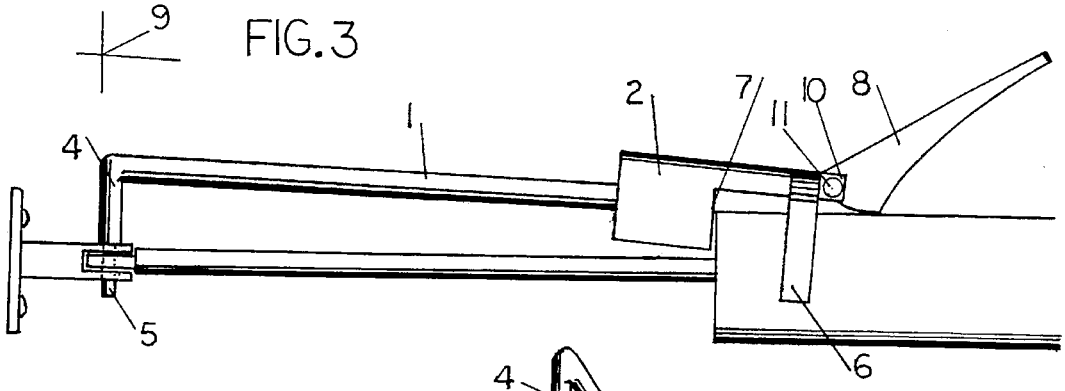
FIG. 3 is a plan view of FIGS. 1 and 2 with the cylinder in an extended position as with the door open. A section of the device then falls below and behind the top edge of the cylinder to create a locking action.

FIG. 3 shows the cylinder in an extended position when the door is fully open the cylinder moves away from block 2 until said block 2 drops off the end of the cylinder at step 7. At this point arm 8 rises, thus giving visual indication that block 2 is a position to secure the door in an open mode.

Referring back to FIGS. 3 and 4, it is evident that the degree of angle 9 between rod 1 and angled extension 4 is more than 90 degrees. This is to ensure that the downward trend of rod 1, along with block 2, is exacerbated enough to force block 2 and, in particular, step 7 to contact the end of the cylinder with more than gravitational force, thus keeping block 2 from rising prematurely.

When the time comes to release step 7 from contact with the cylinder end and return the door to a closed position, arm 8 is pressed in a downward direction forcing block 2 to rise and allowing step 7 to pass over the end of the cylinder.

All Figs. show the hinging apparatus 10 with hinge pin 11 that secures arm 8 to block 2.

What is claimed is:

1. A door holding and releasing mechanism adapted to be attached to a cylinder type door closer, said mechanism comprising:

an elongated rod having an angled end and a threaded end, said angled end having an angled extension with a reduced tip for replacement of a connecting pin of said door closer, said angled extension and said elongated rod forming an angle approximately 90 degrees;

a durable plastic block, one end of said block being threadably attached to said threaded end of said elongated rod and having a step formed therein for engaging an end of the cylinder type closer thereby to hold a door in an open position, two legs extending from the other end of said block adapted to slide on a surface of said cylinder to maintain alignment of said mechanism and said closer;

a release arm being pivotally connected to the other end of said block adjacent said legs for releasing said block from said end of the cylinder thereby to return the door to a closed position.

* * * * *